US006570547B1

(12) United States Patent
Kim et al.

(10) Patent No.: US 6,570,547 B1
(45) Date of Patent: May 27, 2003

(54) DRIVING CIRCUIT FOR A FIELD EMISSION DISPLAY

(75) Inventors: Seung Tae Kim, Seoul (KR); Oh Kyong Kwon, Seoul (KR)

(73) Assignee: Orion Electric Co., Ltd., Kyungsangbuk-do (KR)

( * ) Notice: Subject to any disclaimer, the term of this patent is extended or adjusted under 35 U.S.C. 154(b) by 0 days.

(21) Appl. No.: 09/554,254

(22) PCT Filed: Sep. 9, 1999

(86) PCT No.: PCT/KR99/00526

§ 371 (c)(1),
(2), (4) Date: Jul. 19, 2000

(87) PCT Pub. No.: WO00/16304

PCT Pub. Date: Mar. 23, 2000

(30) Foreign Application Priority Data

Sep. 11, 1998 (KR) ..... 98-37508

(51) Int. Cl.[7] ..... G09G 3/20; G09G 3/10

(52) U.S. Cl. ..... 345/75.2; 345/74.1; 315/169.3

(58) Field of Search ..... 345/75.2, 75.1, 345/74.1, 84, 204, 205, 211, 77, 78; 315/169.1, 169.2, 169.3, 169.4

(56) References Cited

U.S. PATENT DOCUMENTS

| | | | | | |
|---|---|---|---|---|---|
| 5,206,630 | A | | 4/1993 | Kim | |
| 5,656,892 | A | | 8/1997 | Zimlich | |
| 5,751,635 | A | * | 5/1998 | Wong et al. | 365/185.19 |
| 5,754,155 | A | | 5/1998 | Kubota | |
| 5,783,910 | A | * | 7/1998 | Casper et al. | 315/167 |
| 5,856,812 | A | * | 1/1999 | Hush et al. | 345/74.1 |
| 5,894,293 | A | * | 4/1999 | Hush et al. | 345/74.1 |
| 5,920,154 | A | * | 7/1999 | Hush | 315/169.1 |
| 6,028,576 | A | * | 2/2000 | Hush | 345/74.1 |
| 6,097,359 | A | * | 8/2000 | Kwon et al. | 345/74.1 |

FOREIGN PATENT DOCUMENTS

| | | |
|---|---|---|
| EP | 750288 | 12/1996 |
| WO | WO 97/20300 | 6/1997 |
| WO | WO 97/22132 | 6/1997 |
| WO | WO 97/42644 | 11/1997 |

* cited by examiner

*Primary Examiner*—Bipin Shalwala
*Assistant Examiner*—David L. Lewis
(74) *Attorney, Agent, or Firm*—Merchant & Gould P.C.

(57) ABSTRACT

There is a driving circuit disclosed for a field emission display which can reduce the power consumption and thus improve the reliability of high voltage elements by reducing the swing width of the driving voltage necessary for driving the gate, cathode and anode lines arranged to the field emission display. The driving circuit comprises a first switching element arranged between any one line of the plurality of lines and a power supply terminal, for performing a switching operation; a second switching element connected to the first switching element in serial and to any one line of the plurality of lines, for performing a switching operation; a charge charging/discharging element for adjusting the quantity of charge in any one line, in accordance with the state of a control signal inputted thereto and the switching state of the second switching element; a first element controller for controlling a flow of charge to the any one line by switching-controlling the first switching element; and a second element controller for controlling a flow of charge to the any one line by switching-controlling the second switching element.

13 Claims, 11 Drawing Sheets

DRIVING CIRCUIT FOR A FIELD EMISSION DISPLAY

TECHNICAL FIELD

The present invention relates to a field emission display, and more particularly to a driving circuit for a field emission display for driving gate, cathode and anode lines in the field emission display.

BACKGROUND ART

Field emission display (FED), which has been spotlighted as a new flat panel display device, is similar to a cathode ray tube (CRT) in view that it displays a picture on a screen using electrons emitted. However, there is a technical difference therebetween in the point that the field emission display uses a cold electron emission, whereas the cathode ray tube uses a thermal electron emission.

A typical field emission display has some hundreds to thousands of field emission devices for emitting electrons arrayed every pixel and displays a picture on a screen by allowing electrons from the field emission devices to be impinged on an anode having a phosphor film coated thereon.

As shown in FIG. 1, a field emission device composing the pixel of the field emission display comprises a cathode connected to a cathode electrode (10), a gate (14) arranged at predetermined intervals on the cathode (12) and an anode (18) having a phosphor film (16) coated on the rear surface thereof. The phosphor film (16) generates lights corresponding to a quantity of electrons impinged thereon and permits a picture to be displayed on the screen. The anode (18) serves to attract electrons emitted from the cathode (12) and is made of a transparent material so that lights are projected on the phosphor film (16) therethrough.

Also, the cathode (12) is a cone shape of which the top portion forms a microtip. Electrons are emerged from the microtip under the influence of electric fields formed between the cathode (12) and the gate (14). The gate (14) of which voltage is lower than the voltage applied to the anode (18) causes electrons to be emitted from the microtip of the cathode (12), and the emitted electrons go toward the anode (18).

Now, the current to voltage characteristics of the field emission, display composed of such a conventional field emission device will be described below. As shown in FIG. 2, when the field emission display is driven, a cathode current is not substantially flowed until a voltage ($V_{G_C}$) between the gate and the cathode reaches to "$V_L$", and thereafter when the voltage ($V_{G_C}$) becomes higher than "$V_L$", a cathode current becomes sharply high as a diode's characteristic. In FIG. 2, "$V_H$" a driving voltage applied to the: gate is approximately 100 V, and "$V_L$" is about 80 V.

FIG. 3 is a block diagram explaining a driving operation of the panel in a conventional field emission display. As shown in FIG. 3, the panel (20) is a picture displaying region in which field emission devices of pixel unit as depicted in FIG. 1 is arranged in a matrix type. A control unit (22) receives a control signal and an image signal from outside and outputs the corresponding control signal and image signal by controlling them so as to be suitable for the panel characteristic. A gate driver (24), which is connected to a plurality of gate lines, receives a control signal from the control unit (22) and produces a signal for scanning the corresponding gate lines. Data driver (26), which is connected to a plurality of data lines, converts the image signal received from the control unit (22) so as to be suitable for the panel characteristic and then outputs it to each pixel via the data lines.

According to FIG. 3, the gate driver (24) performs a high-voltage switching to emit electrons wherever time when a predetermined gate line is selected by the control signal of the control unit (22). At this time, the data driver (26) outputs the image signal suitable for the panel characteristic to the selected gate line. Accordingly, the desired picture is displayed on the panel.

Herein, the gate driver (24) or the data driver (26) receives a low-voltage signal from the shift register and uses a high voltage output terminal for transmitting a high voltage more than 100 V to the corresponding line. The high voltage output terminal will be described with reference to FIG. 4.

FIG. 4 shows a circuit for driving one gate line or data line (cathode line). The circuit according to FIG. 4 comprises a high voltage PMOS element (P1), a high voltage NMOS element (N1) and a high voltage PMOS element controller (24*a*) for switch-controlling the high voltage PMOS element (P1) by means of an input signal from a control logic (not shown). A drain contact point between the high voltage PMOS element (P1) and the high voltage NMOS element (N1) is connected to the gate line (or data line) of the panel (20).

According to the conventional output terminal circuit having such a construction, as shown in FIG. 5, in accordance with the inputting of a start control signal which is shift-outputted in synchronous with a clock signal (Clk), the high voltage PMOS element (P1) and the high voltage NMOS (N1) are switched conversely and drive the gate lines (for example, n, n+1, n+2) in sequence. Herein, each gate line (n, n+1, n+2) is driven sequentially by a high voltage ($V_{high}$) (for example, 100 V) in a rising edge or a falling edge of the clock signal (Clk)

A consumption power ($P_{conv}$) in the outputting terminal of the conventional driver being operated as described above is represented by the following Equation 1 which indicates a consumption power ($P_{conv}$) in the outputting terminal of the gate driver.

$$P_{conv}=N\cdot f\cdot C_{Load}\cdot V_{high}^2 \qquad \text{<Equation 1>}$$

Wherein, N is the number of the gate lines of FED panel, f is a frame frequency, $C_{Load}$ is a capacitance of one gate line, and $V_{high}$ is the width of voltage swing in the outputting terminal.

In the above Equation 1, if the width of voltage swing ($V_{high}$) is set to 100 V, then the consumption power ($P_{conv}$) is represented by the following Equation 2.

$$P_{conv}=10000\cdot f\cdot C_{Load} \qquad \text{<Equation 2>}$$

As seen from the above Equation 2, for the conventional gate driver, since the output voltage of its outputting terminal is fully swinging from 0V to $V_H$ (for example, 100 V), the power consumption increase, thereby causing an integrating capacity of the gate driver circuit to be reduced when integrating it. Also, there is a problem that a high heat produced by such a high power consumption deteriorates the reliability of high voltage elements. Such problems occur similarly in a driver circuit for driving cathode and anode lines.

DISCLOSURE OF THE INVENTION

Accordingly, the present invention has been made in order to solve such problems encountered in the conventional art as described above, and the object of the present invention is to provide a driving circuit for a field emission display which can reduce the power consumption and thus improve the reliability of high voltage elements by reducing the swing width of the driving voltage necessary for driving the gate, cathode and anode lines arranged to the field emission display.

In order to achieve the above object, the driving circuit for a field emission display according an embodiment of the present invention is characterized in that in a driving circuit for a field emission display having the panel on which a plurality of gate and cathode lines are arranged, the driving circuit comprises:

a first switching element arranged between any one line of the plurality of lines and a power supply terminal, for performing a switching operation;

a second switching element connected to the first switching element in serial and to any one line of the plurality of lines, for performing a switching operation;

a charge charging/discharging element for adjusting the quantity of charge in any one line, in accordance with the state of a control signal inputted thereto and the switching state of the second switching element;

a first element controller for controlling a flow of charge to any one line by switching-controlling the first switching element; and a second element controller for controlling a flow of charge to any one line by switching-controlling the second switching element.

Also, the driving circuit for a field emission display according to other embodiments of the present invention is characterized in that the driving circuit comprises:

a plurality of cells, each cell being connected to each of gate lines in one to one manner;

a shift register for sequentially transmitting a gate line selecting control signal to the plurality of cells;

a capacitor switching control unit for transmitting a capacitor switching control signal having a predetermined pulse width to the plurality of cells;

an external capacitor control unit for outputting a capacitor low switching signal having a predetermined pulse width; and a charge charging/discharging element for performing a charge charging/discharging operation by means of the capacitor low switching signal, wherein said cells comprise a first switching element arranged between a voltage supply terminal and the corresponding gate line, for performing a switching operation; a second switching element connected to the first switching element in serial and to the corresponding gate line, for performing a switching operation; a first element controller for controlling a flow of charge to the corresponding gate line by switching-controlling the first switching element by means of the gate line selecting control signal; and a second element controller for controlling the corresponding gate line and a flow of charge to the charge charging/discharging element by switching-controlling the second switching element by means of the capacitor switching control signal, said shift register, said capacitor switching control unit and said plurality of cells being integrated into one block;

said charge charging/discharging element being arranged one or more to the outside of the block.

BRIEF DESCRIPTION OF THE DRAWINGS

Now, the embodiments of the present invention will be described in detail in conjunction with the accompanying drawings, wherein.

BEST MODE FOR CARRYING OUT THE INVENTION

Figure 1:
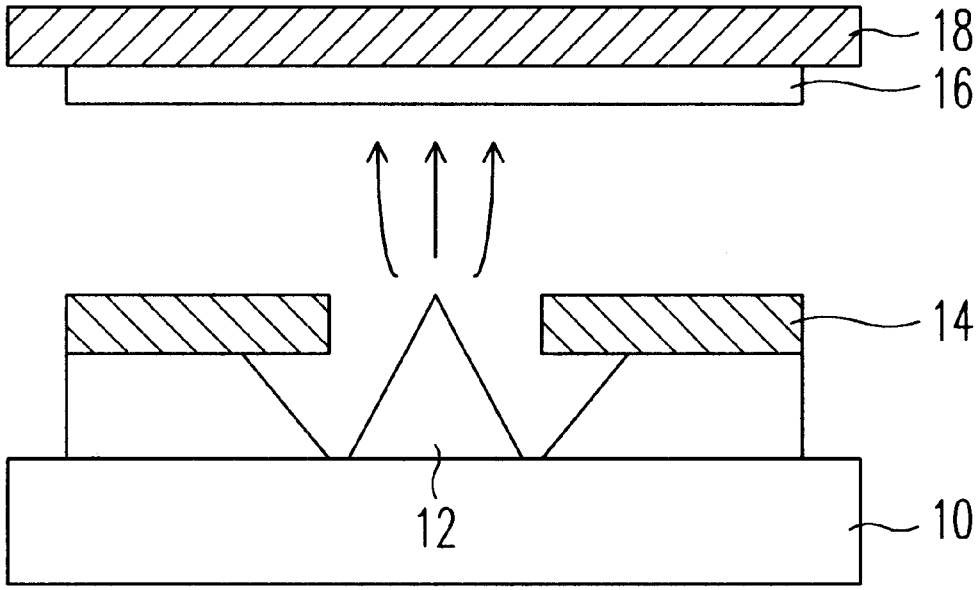
Fig. 1 (prior art)
FIG. 1 is a schematic view showing a structure of a conventional field emission device.
Figure 2:
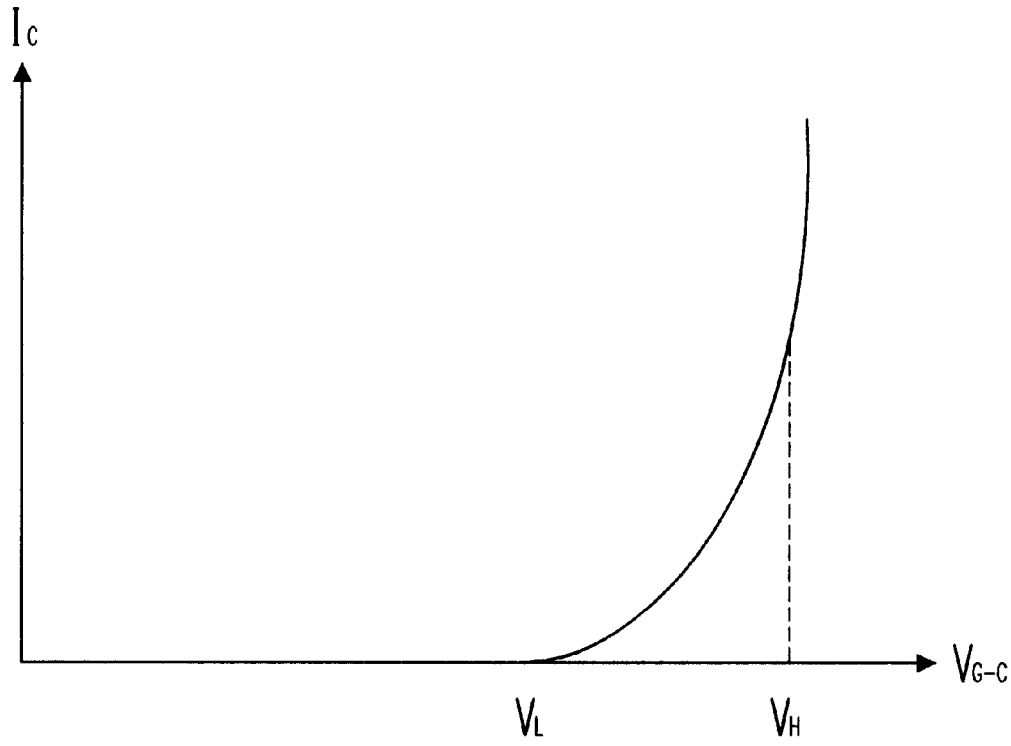
Fig.2 (prior art)
FIG. 2 shows the current—voltage characteristics of the conventional field emission device.
Figure 3:
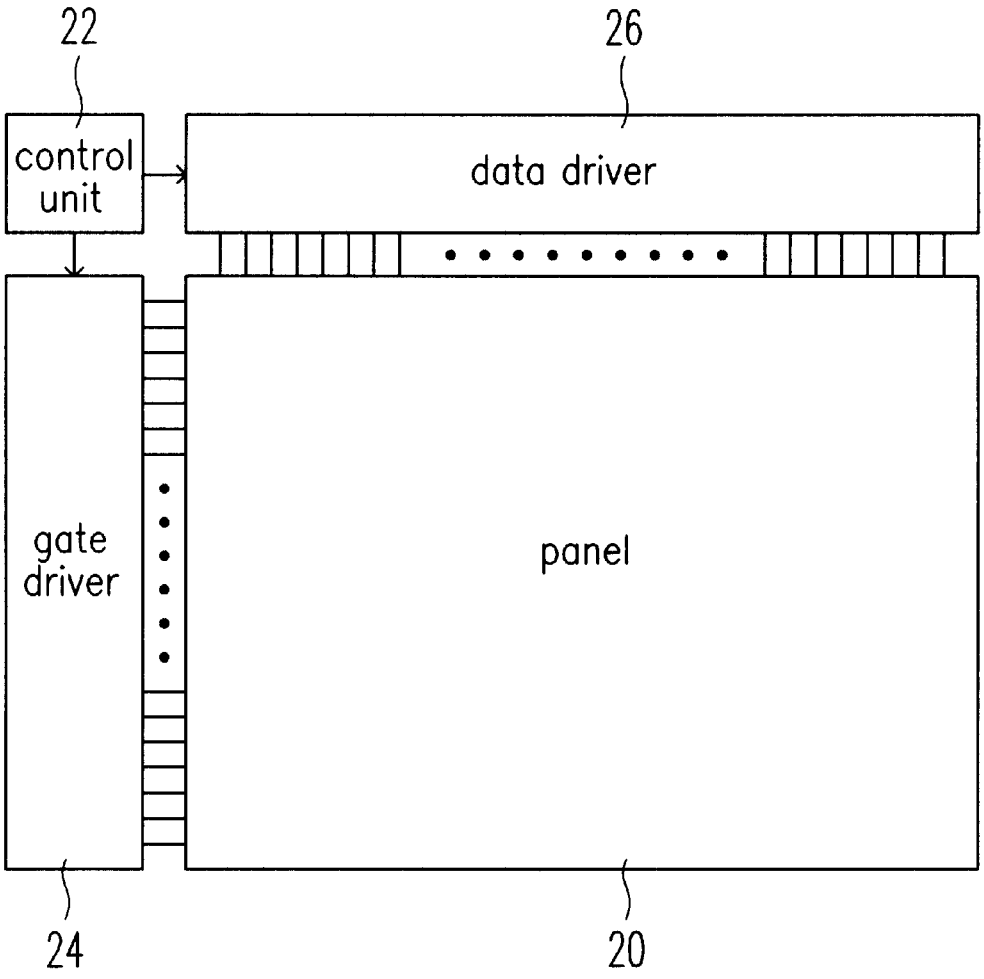
Fig.3 (prior art)
FIG. 3 is a block diagram illustrating a panel driving operation of the conventional field emission device.
Figure 4:
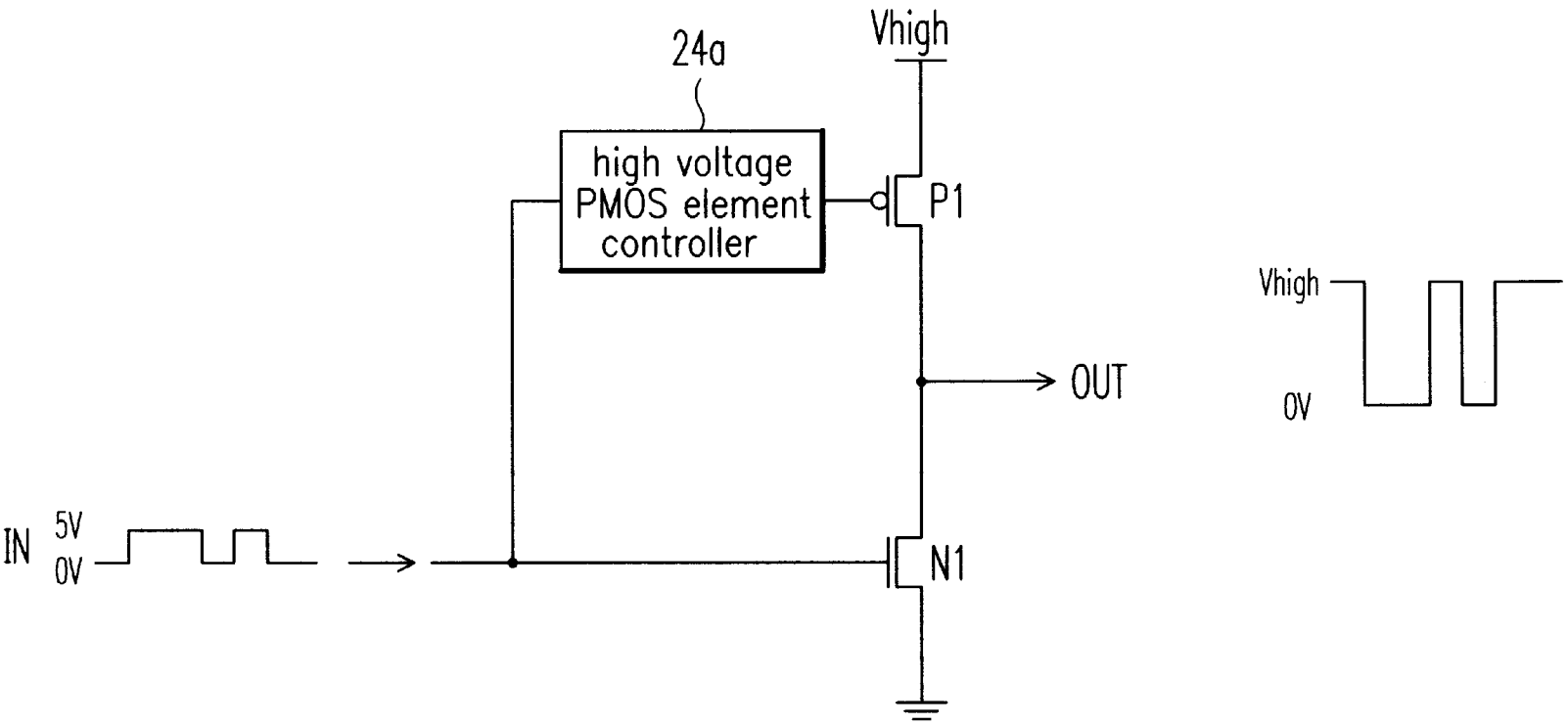
Fig.4 (prior art)
FIG. 4 is a circuit diagram of high voltage outputting terminal of the driver as shown in FIG. 3.
Figure 5:
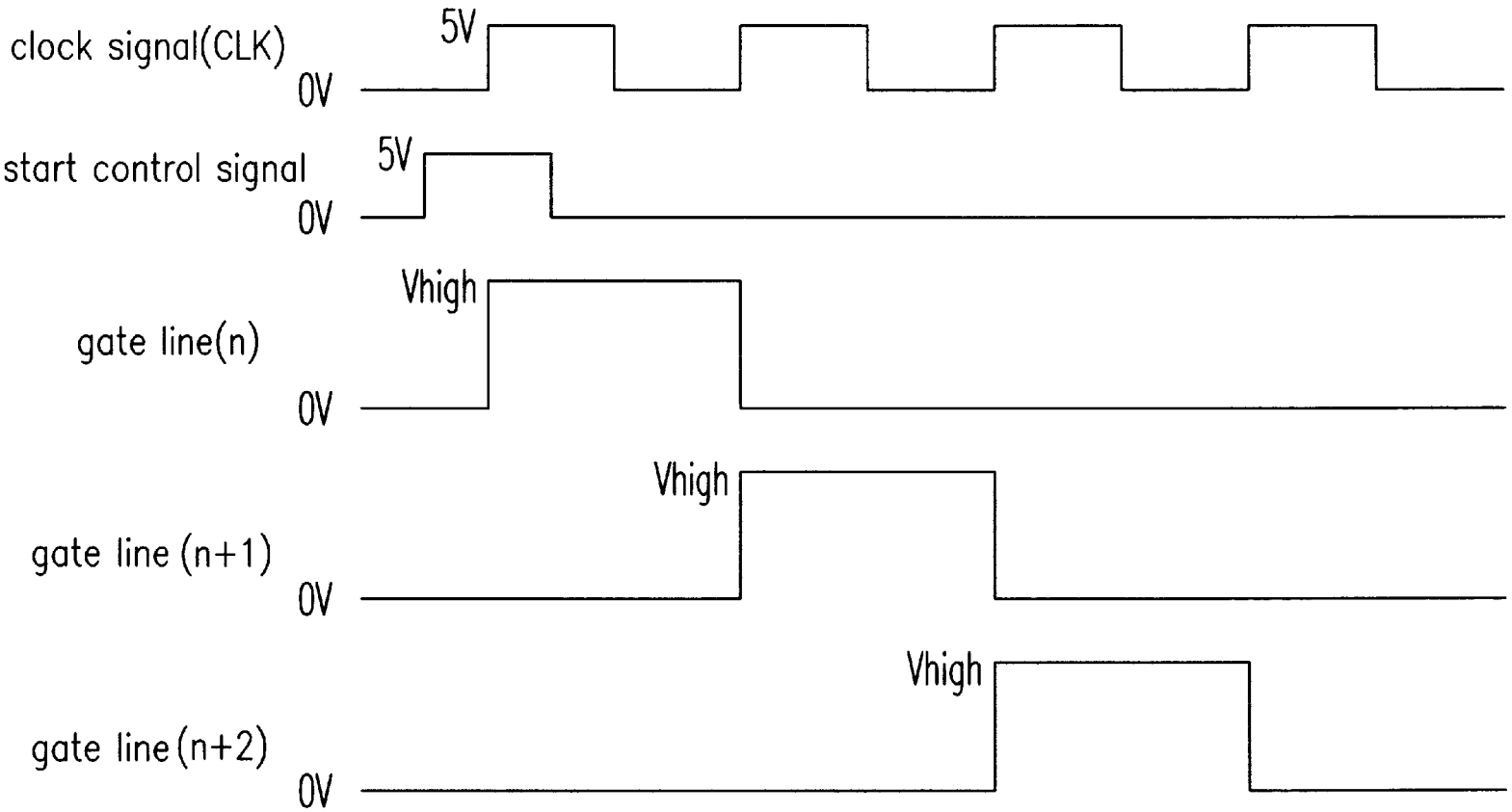
Fig.5 (prior art)
FIG. 5 is a timing chart of the circuit of FIG. 4.
Figure 6:
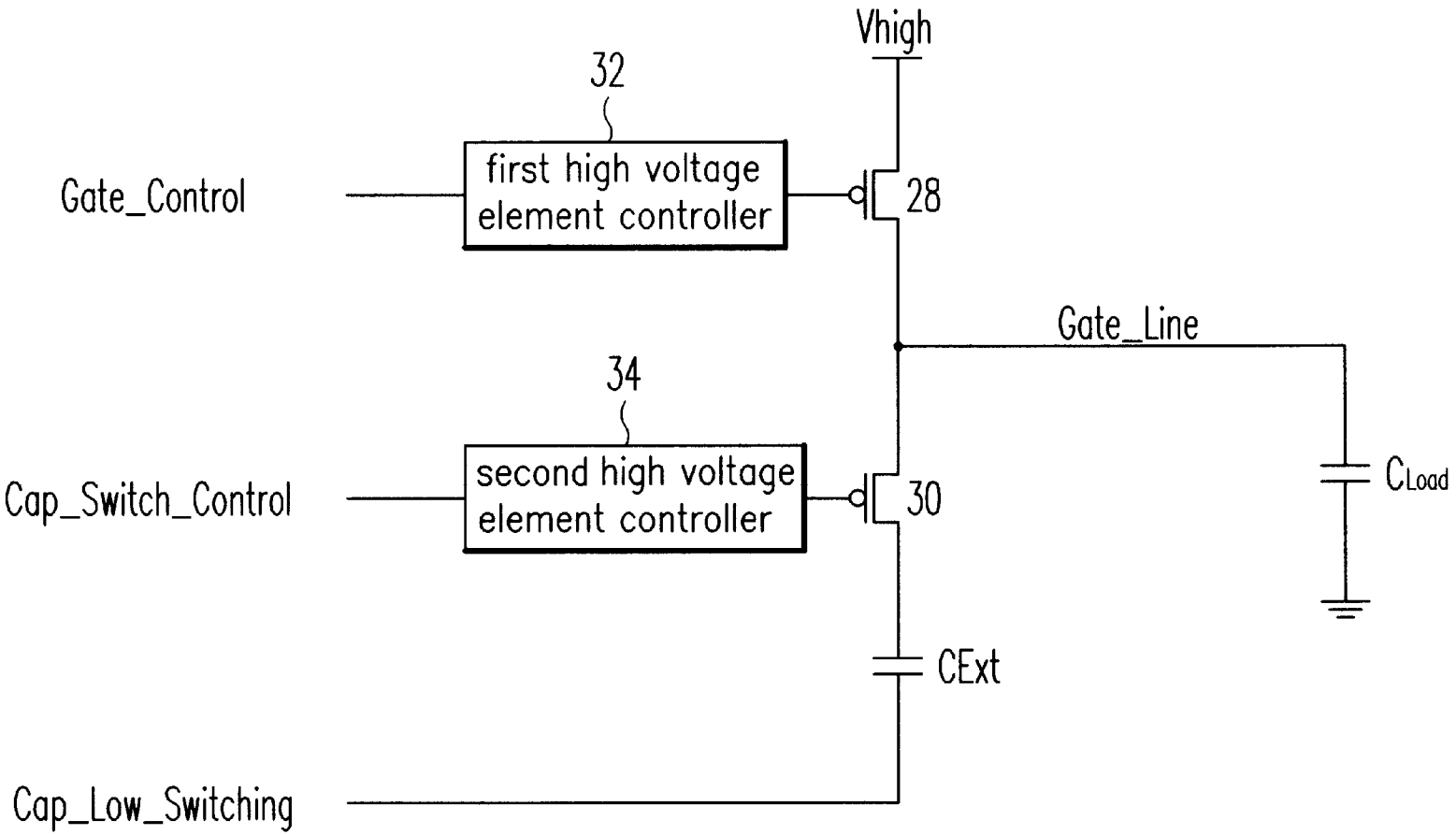
FIG. 6 is a driving circuit diagram for the field emission display according to one embodiment of the present invention.

FIG. 6 is a driving circuit diagram for a field emission display arranged to the gate line, which is depicted in order to illustrate the basic concept of the present invention, and a circuit for driving only one gate line is illustrated to help understand the above-mentioned Figure.

The first switching element (28) is arranged between the high voltage supply terminal ($V_{high}$) and the gate line (Gate_Line) and performs a switching operation by means of the first high voltage element controller (32). The first high voltage switching element is preferably composed of a high voltage PMOS transistor The first high voltage element controller (32) turns on and off the first high voltage switching element (28) in response to receive a gate line selecting control signal (Gate_Control) outputted from a shift register (not shown), thereby controlling the flow of charge to the gate line (Gate_Line).

The second high voltage switching element (30) is connected between the gate line (Gate_Line) and a capacitor low switching signal (Cap_Low_Switching) via a charge charging/discharging element ($C_{Ext}$), and performs the switching operation by means of the second high voltage element controller (34). Preferably, the second high voltage switching element (30) is composed of a high voltage PMOS transistor.

Figure 10:
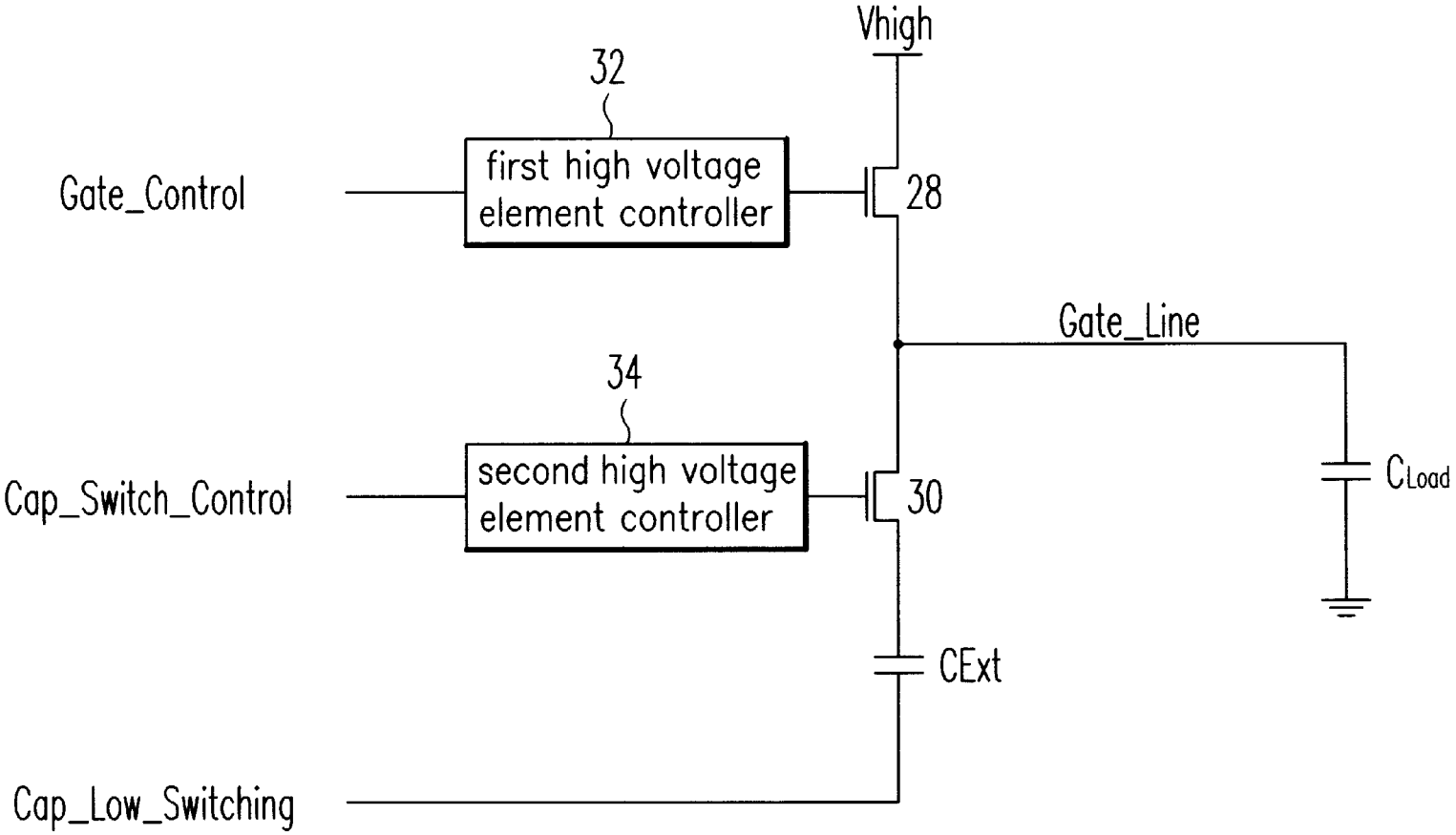
FIG. 10 is a driving circuit diagram for the field emission display according to other embodiments of the present invention.

In a preferred embodiment of the present invention, even though the first and second high voltage switching elements (28, 30) are embodied by the high voltage PMOS transistors, high voltage NMOS transistors can be used as shown in FIG. 10, instead thereof.

The second high voltage element controller (34) controls a switching of the second high voltage switching element (30) in response to receive a capacitor switch control signal (Cap_Switch_Control), thereby controlling the gate line (Gate_Line) and a flow of charge to the charge charging/discharging element ($C_{Ext}$).

Herein, the gate line selecting control signal (Gate_control) is a signal for selecting a gate line to be scanned, and is converted to either a high level or a low level in accordance with the period of a clock signal (Clock).

The capacitor switch control signal (Cap_Switch_Control), which is a signal for turning on the second switching element (30) in order to transmit a part of charge of the gate line (Gate_Line) to the charge charging/discharging element ($C_{Ext}$), is raised to be preceded by a predetermined value ($\alpha$) more than the gate line selecting control signal (Gate_Control) and its width is wider by ½ clock duration than the signal (Gate_Control).

The capacitor low switching signal (Cap_Low_Switching), which is a signal having a predetermined width ($0V \sim V_{cap}$) of voltage swing, is applied to the charge charging/discharging element ($C_{Ext}$).

The internal circuit composed of the first and second high voltage element controllers (32, 34) can be constructed to turn on each of the first and second switching elements (28, 30) in case that the gate line selecting control signal (Gate_Control) and the capacitor low switching signal (Cap_Low_Switching), which are inputted to the controllers (32, 34) respectively, are at their high level. The internal circuit can also be constructed to turn on each of the first and second switching elements (28, 30) in case that the gate line selecting control signal (Gate_Control) and the capacitor low switching signal (Cap_Low_Switching), which are inputted to the controllers (32, 34) respectively, are at their low level.

The charge charging/discharging element ($C_{Etx}$) is arranged between the input terminal of the capacitor low switching signal (Cap_Low_Switching) and the second high voltage switching element (30) and thus controls the quantity of charge in the gate line (Gate_Line) in accordance with the state of the capacitor low switching signal (Cap_Low_Switching) and the switching state of the second high voltage switching element (30).

Figure 7:
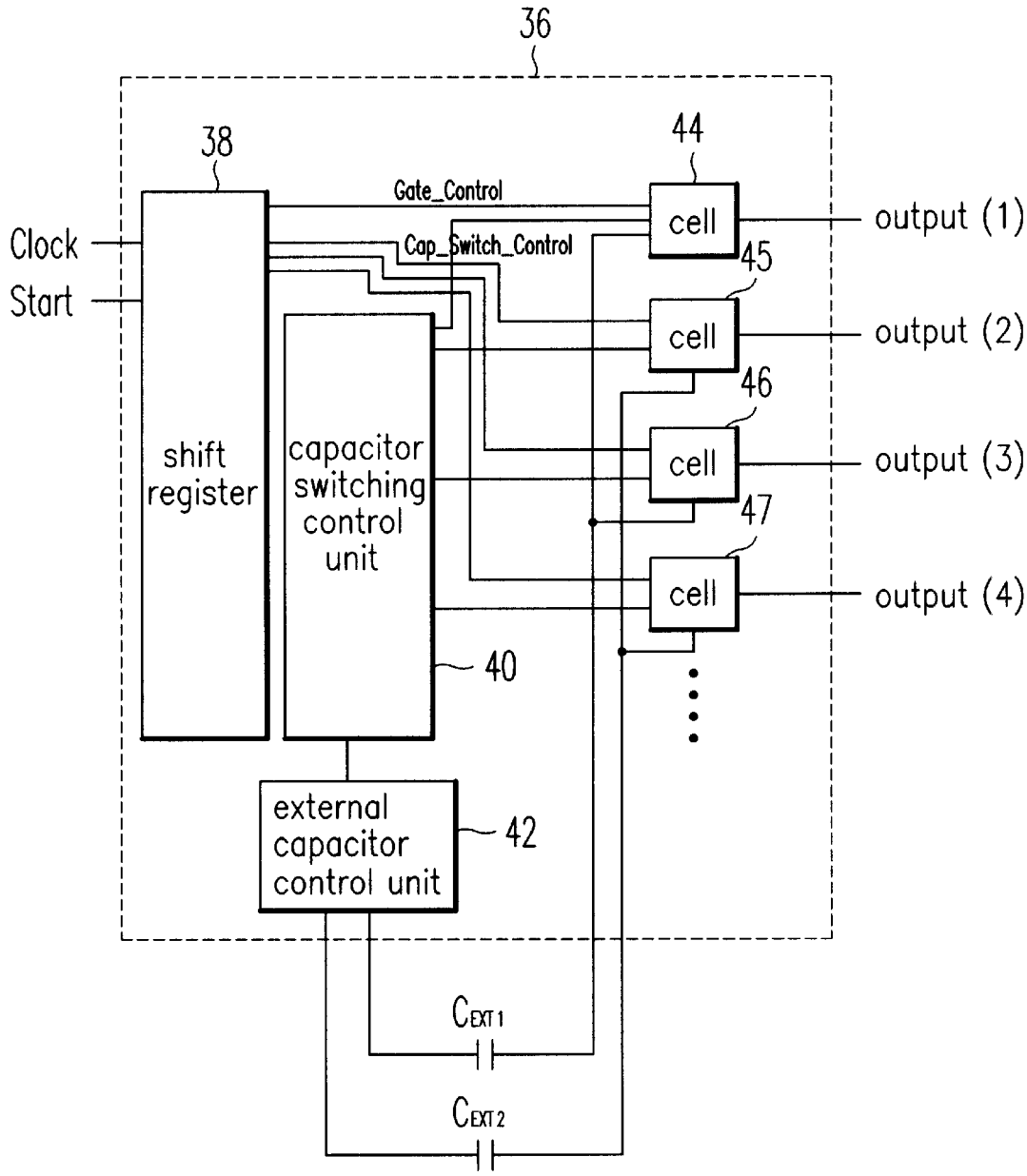
FIG. 7 illustrates one example in which the driving circuit for the field emission display as shown in FIG. 6 has been integrated into an integrated circuit as a cell unit.

FIG. 7 illustrates a state in which the driving circuit as shown in FIG. 6 was integrated as a cell unit. As depicted, the first and second switching elements (28, 30) and the first and second high voltage PMOS element controllers (32, 34) are integrated into a single block (36) with being formed as one cell unit, while a plurality of charge charging/discharging elements ($C_{Ext1}$, $C_{Ext2}$) are arranged to the outside of the integrated block (36).

Herein, the gate line selecting control signal (Gate_Control) applied to each of cells (44, 45, 46, 47, . . . ) is a signal outputted from the shift register (38), and the capacitor switching control signal (Cap_Switch_Control) is a signal outputted from the capacitor switching control unit (40).

The plurality of charge charging/discharging elements ($C_{Ext1}$, $C_{Ext2}$) are controlled by the external capacitor control unit (42) connected to the capacitor switching control unit (40).

In FIG. 7, even though the capacitor switching control unit (40) and the external capacitor control unit (42) were separately integrated into the single block (36), it should be noted that the external capacitor control unit (42) can be integrated into the capacitor switching control unit (40).

Meanwhile, since the plurality of cells (44, 45, 46, 47, . . . ) use the charge charging/discharging elements ($C_{Ext1}$, $C_{Ext2}$) only when gate lines are selected, one charge charging/discharging element ($C_{Ext1}$) or ($C_{Ext2}$) is shared with every odd-numbered or even-numbered cells. That is, the odd-numbered cells (44, 46, . . . ) share the charge charging/discharging element ($C_{Ext1}$), and the even-numbered cells (45, 47, . . . ) share the charge charging/discharging element ($C_{Ext2}$).

More precisely, one end of the charge charging/discharging element ($C_{Ext1}$) is connected to one control end of the external capacitor control unit (42), and other ends thereof are the odd-numbered cells (44, 46, . . . ). Also, one end of the charge charging/discharging element ($C_{Ext2}$) is connected to the other control end of the external capacitor control unit (42), and other ends thereof the even-numbered cells (44, 46, . . . ).

Accordingly, the charge charging/discharging elements ($C_{Ext1}$, $C_{Ext2}$) connected to the odd-numbered cells (44, 46, . . . ) and the even-numbered cells (45, 47, . . . ) are alternately driven by the external capacitor control unit (42), when gate lines of the odd-numbered lines and the even-numbered lines (output (1), output (2), output (3), output (4), in FIG. 7) are driven.

Figure 11:
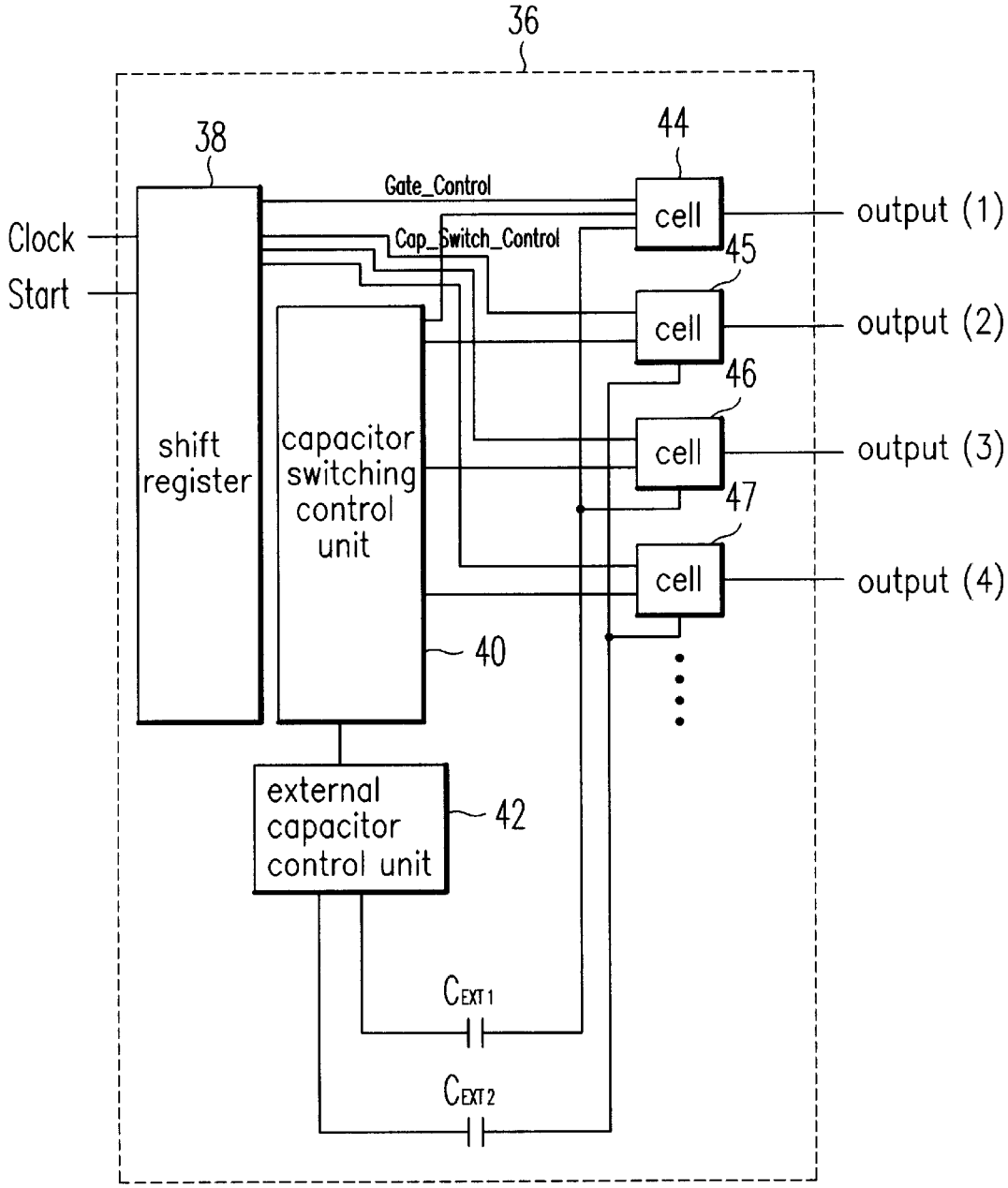
FIG. 11 illustrates other examples in which the driving circuit for the field emission display as shown in FIG. 6 has been integrated into an integrated circuit as a cell unit.

In the preferred embodiment of the present invention, even though the charge charging/discharging elements ($C_{Ext1}$, $C_{Ext2}$) were arranged on the outside of the integrated block (36), it can be integrated into the capacitor switching control unit (40) as shown in FIG. 11.

Now, an explanation will be made about the driving operation of the driving circuit for the field emission display according to the embodiment of the present invention constructed as described above in which the driving circuit has a gate line connected thereto.

FIG. 10 is another embodiment of the present invention. The explanation regarding FIG. 10 is omitted since its circuit construction and operation are substantially same as that of FIG. 6.

Figure 8:
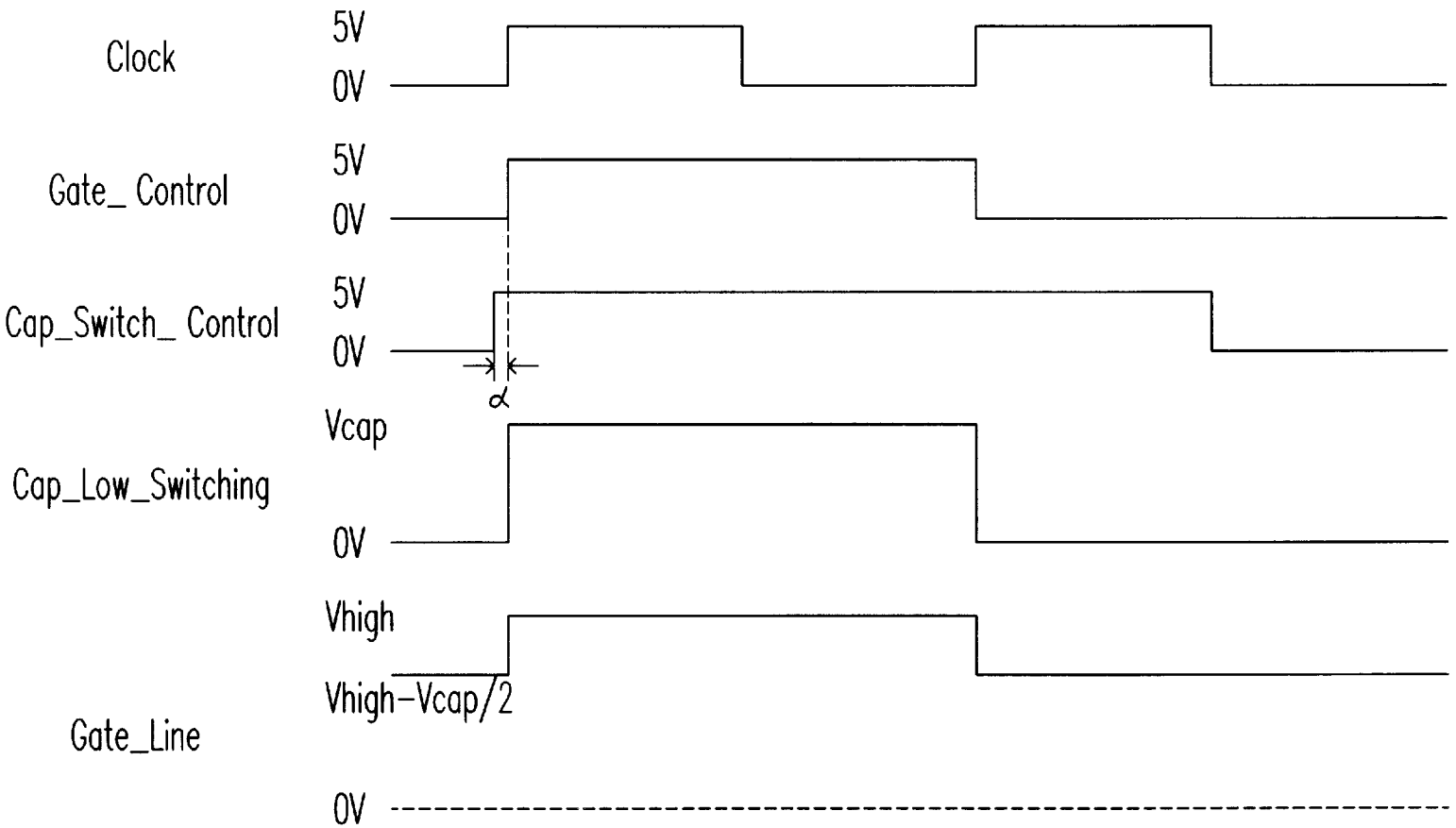
FIG. 8 is a timing chart of the driving circuit for the field emission display as shown in FIG. 6.
Figure 9:
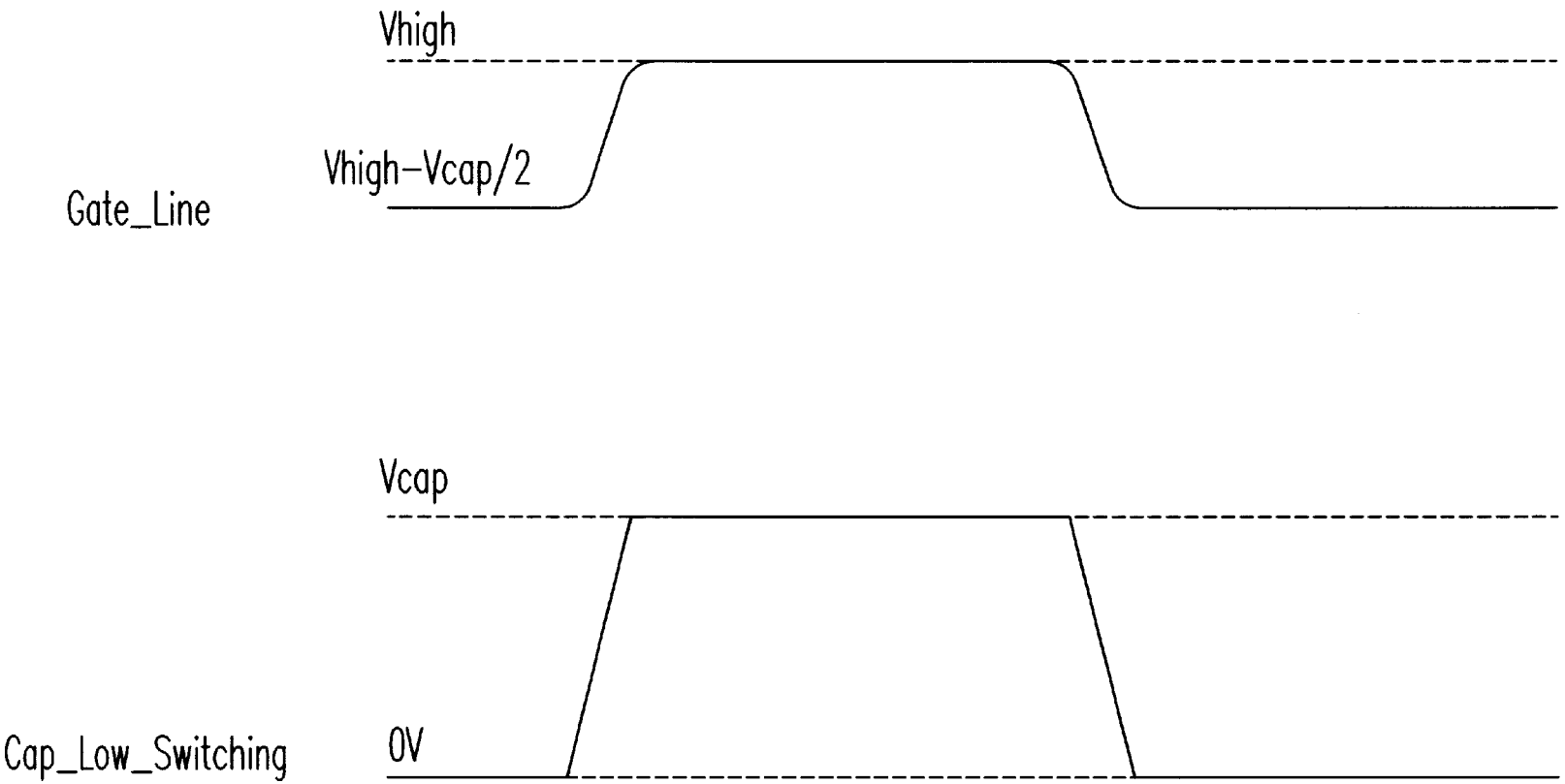
FIG. 9 is a waveform view illustrating in detail a voltage change in the gate line in accordance with the present invention.

First, in the embodiment of the present invention, it is assumed that in the initial state, the voltage of the gate line (Gate_Line) is "$V_{high}-V_{cap}/2$", and the capacitor lower switching signal (Cap_Low_Switching) is 0V as illustrated in FIGS. 8 and 9.

In FIG. 8, since the capacitor switching control signal (Cap_Switch_Control) is raised to be preceded by a predetermined value ($\alpha$) more than the gate line selecting control signal (Gate_Control), the second high voltage switching element (30) is turned on by the second high voltage controller (34) before than the first high voltage switching element (28), and when the capacitor low switching signal (Cap_Low_Switching) is raised from "0V" to "$V_{cap}$", a charge resident on the charge charging/discharging element ($C_{Ext}$) is progressively transmitted to the gate line (Gate_Line) via the second high voltage switching element (30), thereby allowing the voltage of the gate line (Gate_Line) to be close to "$V_{high}$".

Thereafter, as the gate line selecting control signal (Gate_Control) has been raised, the first high voltage switching element (28) is turned on by the first high voltage element controller (32), and the high voltage ($V_{high}$) is applied to the gate line (Gate_Line) via the first high voltage switching element (28). Consequently, the voltage of the gate line (Gate_Line) becomes high voltage ($V_{high}$) level.

The voltage of the gate line (Gate_Line) continuously maintains the high voltage level ($V_{high}$), while the gate line selecting control signal (Gate_Control) maintains the high level (for example, 5V), and the capacitor low switching signal (Cap_Low_Switching) maintains "$V_{cap}$" level.

In this state, if the gate line selecting control signal (Gate_Control) and the capacitor low switching signal (Cap_Low_Switching) are dropped before than the capacitor switching control signal (Cap_Switch_Control), the second high voltage switching element (30) is turned on while the first high voltage switching element (28) is turned off.

Accordingly, the voltage of the gate line (Gate_Line) is dropped. That is, since the charge in the gate line (Gate_Line) is transmitted to the charge charging/discharging element ($C_{Ext}$) via the second high voltage switching element (30), the voltage of the gate line (Gate_Line) is returned to its initial voltage ($V_{high}-V_{cap}/2$).

Now, an explanation will be made about the driving operation according to the embodiment of the present invention as described above using a numerical expression.

When the gate line selecting control signal (Gate_Control) becomes a high level (that is, 5V), if the capacitor switching control signal (Cap_Switch_Control) is set to be high level (That is, 5V), and the voltage of the capacitor low switching signal (Cap_Low_Switching) on the end of the charge charging/discharging element ($C_{Ext}$) raises to "$V_{cap}$", the capacitor ($C_{Load}$) of the gate line (Gate_Line) and the charge charging/discharging element ($C_{Ext}$) are charged by the high voltage ($V_{high}$). In this time, the capacitor ($C_{Load}$) and the charge charging/discharging element ($C_{Ext}$) are represented by the following equation.

$$Q_{Total}=C_{Load}\cdot V_{high}+C_{Ext}(V_{high}-V_{cap}) \quad \text{<Equation 3>}$$

Thereafter, when the gate line selecting control signal (Gate_Control) becomes a low level (that is, 0V), if the capacitor switching control signal (Cap_Switch_control) is maintained at its high level (that is, 5V), and the capacitor low switching signal (Cap_Low_Switching) becomes 0V, the voltage of the gate line (Gate_Line) will be dropped.

At this time, the quantity of charge which is charged on the capacitor ($C_{Load}$), and the charge charging/discharging element ($C_{Ext}$) is represented by the following Equation 4.

$$Q_{Total}=C_{Load}\cdot V_{high}+C_{Ext}(V_{high}-V_{cap})=C_{Load}(2V_{high}-V_{cap}),\ \text{if } C_{Load}=C_{Ext},\ \text{then}=2C_{Load}(V_{high}-V_{cap}/2)=2C_{Load}V_{Low} \quad \text{<Equation 4>}$$

Accordingly, the voltage of the gate line (Gate_Line) is represented by the following Equation 5.

$$V_{Low}=V_{high}-V_{cap}/2 \quad \text{<Equation 5>}$$

According to the embodiment described above, as shown in FIG. 9, the voltage of the gate line (Gate_Line) is swinging in the voltage scope ranging from "$V_{high}-V_{cap}/2$" to $V_{high}$. That is, the swing width of the output voltage for driving the gate line (Gate_Line) is equal to "$V_{cap}/2$".

The power consumption at this moment, namely, the power ($P_{Load}$) consumed in charging the capacitor ($C_{Load}$) of the gate line (Gate_Line), the power ($P_{cap}$) consumed in swinging the charge charging/discharging element ($C_{Ext}$) and the total power consumption ($P_{Total}$) are represented by equations (6), (7) and (8) respectively.

$$P_{Load}=N\cdot f\cdot C_{Load}\cdot V_{high}\cdot V_{cap}/2 \quad \text{<Equation 6>}$$

Wherein N is the number of the gate lines of the field emission display panel, f is the frame frequency, $C_{Load}$ is capacitance of one gate line, $V_{high}$ is the width of the voltage swing in the output terminal, and $V_{cap}$ is the width of the voltage swing of the signal (Cap_Low_Switching) applied to the charge charging/discharging element ($C_{Ext}$).

$$P_{cap}=N\cdot f\cdot C_{Ext}\cdot V_{cap}^{2} \quad \text{<Equation 7>}$$

$$P_{Total}=N\cdot f\cdot C_{Load}\cdot V_{cap}(V_{high}/2\cdot V_{cap}) \quad \text{<Equation 8>}$$

Herein, from Equation 8, if $V_{high}$=100V and $V_{cap}$=40V, then the total power consumption ($P_{Total}$) is obtained from the following equation.

$$P_{Total}=3600\cdot N\cdot f\cdot C_{Load}=(36/100)P_{conv} \quad \text{<Equation 9>}$$

Wherein $P_{conv}$ is the consumption power in the conventional art as shown in Equation 2.

According to the embodiment of the present invention, it can be understood that since the swing width of the output voltage is in the scope of "80V" to "100V", the scope is narrower than that of the conventional art which is ranged from 0V to 100V and that when compared to the conventional art with respect to only power consumption in the output terminal, only 36% of the power is consumed.

According to the present invention as described above, the swing width of the output voltage can be narrowed, thereby reducing the power consumption.

Also, since the voltage applied to the high voltage element is small, the reliability of the driving circuit can be improved. Owing to the reduced power consumption, the heating amount of the driving circuit is also reduced, and thus the reliability of the device over a heat is improved. Also, with the reduction of the heating amount, it becomes easy to package the gate driving circuit.

Further, since it is possible to reduce the size and heating amount of the high voltage device, compared to the conventional art, it is possible to integrate many output terminals into one integrated circuit.

The driving circuit applied to the gate line according to the embodiment of the present invention can also be applied to the cathode line and anode lines.

Although the preferred embodiments of the present invention have been disclosed for illustrative purposes, the present invention is not limited to it, and various variations, modifications and additions may be made without departing from the scope of the present invention.

What is claimed is:

1. A driving circuit for a field emission display comprising:

a plurality of cells, each cell being connected to each gate line in an one to one manner;

a shift register for sequentially transmitting a gate line selecting control signal to said plurality of cells;

a capacitor switching control unit for transmitting a capacitor switching control signal having a predetermined pulse width to said plurality of cells;

an external capacitor control unit for outputting a capacitor low switching signal having a predetermined pulse width; and a capacitance for performing a charge charging/discharging operation in accordance with said capacitor low switching signal, wherein said cells comprise a first switching element formed between a power supply terminal and the corresponding gate line, for performing a switching operation; a second switching element connected to the first switching element in serial and to the corresponding gate line, for performing a switching operation; a first element controller for controlling a flow of charge to the corresponding gate line by switching-controlling the first switching element by the control signal for selecting the gate line; and a second element controller for controlling a flow of charge to the corresponding gate line and the capacitance by switching-controlling the second switching element by the capacitor switch control signal;

said shift register, said capacitor switch control unit and said plurality of cells being integrated in one block;

said capacitance being arranged one or more to be on the outside of the block.

2. A driving circuit according to claim 1, wherein said plurality of cells share said capacitance.

3. A driving circuit according to claim 2, wherein said plurality of cells share one capacitance every odd-numbered and even-numbered cells.

4. A driving circuit according to claim 1, wherein said capacitance arranged to said odd-numbered and even-numbered cells are alternately driven.

5. A driving circuit according to claim 1, wherein one or more of said capacitance arranged into said integrated block.

6. A driving circuit according to claim 1, wherein the width of said capacitor switching control signal is wider than that of said gate line selecting control signal.

7. A driving circuit according to claim 1, wherein said first and second switching elements are composed of high voltage MOS transistor.

8. A driving circuit according to claim 1, wherein when said gate line is driven, said second switching element becomes conductive earlier than said first switching element.

9. A driving circuit according to claim 1, wherein when said gate line is driven, said first switching element becomes non-conductive earlier than said second switching element.

10. A driving circuit according to claim 1, wherein an output voltage of said gate line is controlled by the capacity of said capacitance.

11. A driving circuit according to claim 1, wherein an output voltage of said gate line is controlled by the voltage and waveform applied to the capacitance.

12. A driving circuit according to claim 1, wherein when said gate line is driven, the width of voltage swing of the corresponding line is "$V_{cap}/2$", wherein $V_{cap}$ is the width of voltage swing of the control signal applied to the charge charging/discharging element.

13. A driving circuit according to claim 1, wherein when said first element controller and said second element controller in response to receive an active signal, for turning on said first switching element and said second switching element, respectively.

* * * * *